United States Patent [19]

Moshier

[11] Patent Number: 5,060,348

[45] Date of Patent: Oct. 29, 1991

[54] BRASSIERE STRAP RETAINER

[76] Inventor: David R. Moshier, 18620 Hatteras, #275, Tarzana, Calif. 91356

[21] Appl. No.: 505,805

[22] Filed: Apr. 6, 1990

[51] Int. Cl.[5] ..... A44B 18/00

[52] U.S. Cl. ..... 24/442; 2/107; 2/DIG. 6

[58] Field of Search ..... 2/DIG. 6, 268, 323, 2/107, 342; 24/306, 442; 128/DIG. 15; 224/901

[56] References Cited

U.S. PATENT DOCUMENTS

| | | | |
|---|---|---|---|
| 2,699,550 | 1/1955 | Freid | 2/107 X |
| 4,125,904 | 11/1978 | Levine . | |
| 4,382,303 | 5/1983 | Lunt . | |
| 4,575,874 | 3/1986 | Johnson . | |
| 4,612,935 | 9/1986 | Greifer . | |
| 4,704,745 | 11/1987 | Reaver . | |
| 4,764,988 | 8/1988 | Reaver . | |
| 4,953,233 | 9/1990 | Moshier | 2/268 |

FOREIGN PATENT DOCUMENTS

| | | | |
|---|---|---|---|
| 890481 | 9/1953 | Fed. Rep. of Germany | 2/268 |

*Primary Examiner*—James R. Brittain

*Attorney, Agent, or Firm*—John J. Posta, Jr.

[57] ABSTRACT

The brassiere strap retainer includes a first generally flat strip having a plurality of hooks protruding up from the top surface thereof and a generally smooth bottom surface. The first strip has a number of spaced tabs integral therewith and extending laterally from opposite sides thereof. The tabs bear some of the hooks. The tabs are looped around and spaced below the bottom surface of the first strip so that the tab hooks project downwardly from the first strip.

A second flat strip is used in the retainer and has a generally smooth bottom surface and an upper surface releasably connected to the tab hooks to form with the first strip a hollow tube within which a strap of a brassiere is releasably slidably trapped. The position of the garment is controlled by attaching the retainer to the brassiere strap. Instead of a single second strip, one can use a plurality of second strips which bridge the tabs on opposite sides of the first strip. The strips can be fixedly secured together at one of their respective sides. The retainer is simple and effective.

12 Claims, 1 Drawing Sheet

BRASSIERE STRAP RETAINER

BACKGROUND OF THE INVENTION

1. Field of the Invention

The present invention generally relates to retainers and more particularly to brassiere strap retainers of an improved type.

2. Prior Art

Brassiere straps frequently form a source of embarrassment by becoming clearly visible when a brassiere is being worn under a sleeveless sweater, blouse, tank top or the like or under any upper brassiere-covering garment with a wide and/or deep neck opening and/or large arm holes. Women frequently adjust their garments under such circumstances in an attempt to conceal the brassiere straps. However, the straps have a habit of coming into view despite efforts to conceal them.

Accordingly, there is a need for a device capable of releasably keeping a brassiere strap out of sight behind a sleeveless sweater, blouse or the like or behind any upper garment having a wide and/or deep neck opening or large armholes. Such device should be small, light in weight and easily concealed.

Various devices have been designed in the past for such purposes. See, for example, U. S. Pat. Nos. 4,125,904; 4,382,303; 4,575,874; 4,612,935; 4,704,745 and 4,764,988. While one or more of the devices disclosed in these patents satisfy certain of the needs of an improved brassiere strap concealer, none of the devices disclosed satisfy all the desired features in such a device. Most such devices are complicated, expensive and difficult to use. Instead, what is needed is a device which is simple, inexpensive, durable and capable of anchoring a garment to a brassiere strap while still allowing the brassiere to move easily along with normal body movements.

SUMMARY OF THE INVENTION

The improved brassiere strap retainer of the present invention satisfies all the foregoing needs. The retainer is substantially as set forth in the Abstract of the Disclosure.

The retainer comprises a first generally flat strip having its entire upper surface bearing hooks protruding therefrom. The bottom surface of the first strip is relatively smooth. That first strip also has a plurality, for example, three spaced tabs on each of the two opposite sides of the strip and aligned with each other to form pairs.

When the first strip is used, the tabs are looped down and around the opposite side edges of the strip to a position below the strip and spaced from it, with the hooks of the tabs pointing downwardly. A second strip having a hook-receiving upper surface has that upper surface releasably connected to the tabs through the tab hooks to form therewith a channel, tunnel or tube with relatively smooth insides, within which a brassiere strap is slidingly trapped. The hooks on the upper surface of the main body of the first strip are then used to releasably anchor the first strip to the inside of the slip, blouse, sweather or the like upper garment being worn by the brassiere wearer, in a position which conceals the brassiere strap and keeps it concealed.

Accordingly, the brassiere strap retainer of the present invention has improved properties over conventional retainers.

In a second embodiment, instead of employing a single large sheet as the second strip, a series of long narrow strips are used to bridge the members of each pair of tabs and thus provide a tube or tunnel similar to that of the configuration described above.

Various other features of the improved brassiere strap retainer of the present invention are set forth in the following detailed description and accompanying drawings.

DRAWINGS

Figure 1:
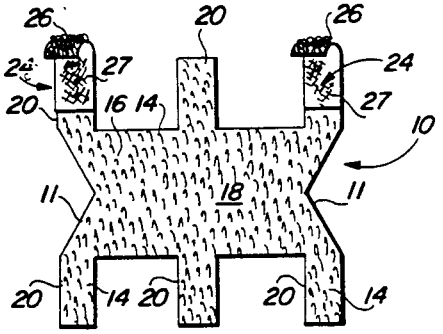
FIG. 1 is a schematic top plan view of a preferred embodiment of the improved brassiere strap retainer of the present invention, showing the first strip of the retainer bearing one of the small second strips of the retainer.
Figure 4:
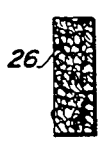
Figure 6:
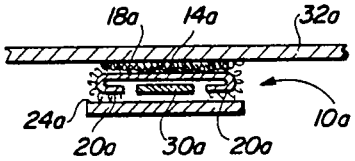
Figure 2:
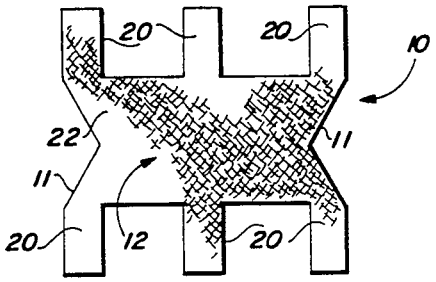
FIG. 2 is a schematic bottom plan view of the first strip of FIG. 1.
Figure 8:
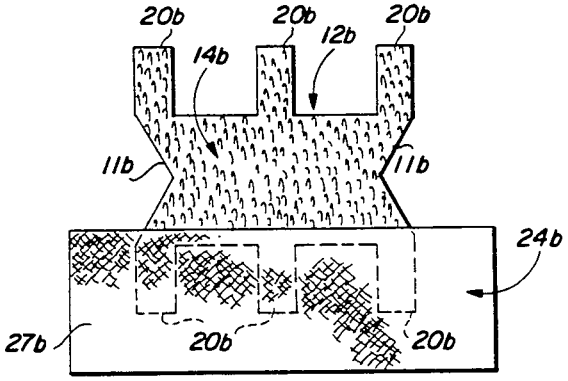
Figure 3:
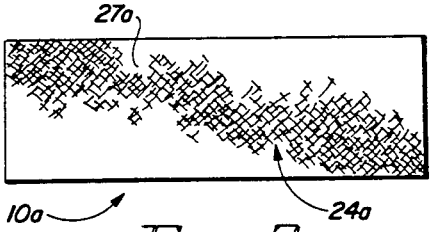
Figure 5:
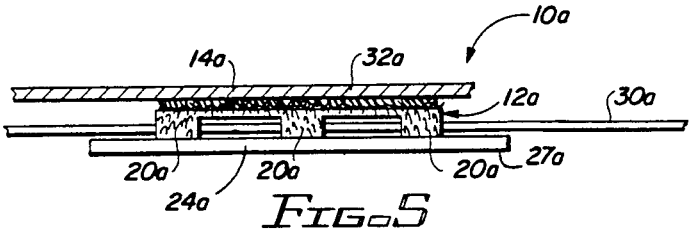
Figure 7:
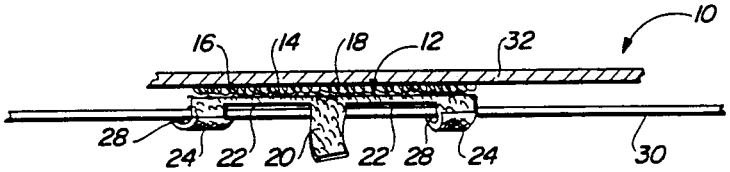

FIG. 3 a schematic top plan view of the second strip of another preferred embodiment of the improved brassiere strap retainer of the present invention;

FIG. 4 is a schematic bottom plan view of one of the second strips used in the retainer of FIG. 1;

FIG. 5 is a fragmentary schematic side elevation of the second preferred embodiment of the improved brassiere strap retainer of the present invention shown in position around a brassiere strap;

FIG. 6 is a fragmentary schematic end view, partly in section, showing the retainer of FIG. 5;

FIG. 7 is a schematic fragmentary side elevation of the first embodiment of the retainer of the present invention; and, FIG. 8 is a top plan view of the embodiment of the invention shown in FIGS. 5 and 6.

DETAILED DESCRIPTION

FIGS. 1, 2, 4 and 7

A first preferred embodiment of the improved brassiere strap retainer of the present invention is schematically depicted in FIGS. 1, 2, 4 and 7 of the drawings. Thus, retainer 10 is shown which comprises a first generally flat, elongated strip 12 with indented ends 11, said strip having a plurality of spaced hooks 14 protruding upwardly from the entire top surface 16 thereof, including the main body 18 thereof and the spaced tabs 20 protruding laterally from opposite sides of strip 12. Any suitable number of tabs 20 can be employed, for example, three on each of the two opposite sides, aligned in groups of three pairs, one tab 20 of each pair being on one side of strip 12 and the other tab 20 of each pair being on the opposite side of strip 12. The bottom surface 22 of strip 12 does not bear any hooks 14 and is preferably relatively smooth.

A plurality, in this case, three, of what is termed hereinafter as small, tab-size second flat strips 24 are releasably connected to the hook-bearing top surfaces of three of tabs 20 by the hook-receiving bottom surfaces 26 thereof and preferably extend laterally thereof. The top surfaces 27 thereof may be relatively smooth.

It will be understood that surfaces 26 may be formed of woven looped material and/or felted material so to readily engage hooks 14 and hold strips 24 to strip 12. Strips 24 can in whole or in part be formed of woven material, with the usual types of hook and loop Velcro material to engage hooks 14. Strip 12 may be, for example, about 3 inches long and about 0.75–1 inch in width. Strips 24 may be, for example, about 0.25 inch wide and about 0.25–0.50 inch long, similar in length and width to tabs 20. Other suitable sizes and shapes for tabs 20, and strips 12 and 24 can be used.

When it is desired to use retainer 10, strips 24 are connected in the manner shown in FIGS. 1 and 7 to one side of strip 12 and tabs 20 are looped down, around and under main body 18 of strip 12 to the position shown for the two end tabs 20 in FIG. 7. This places hooks 14 on tabs 20 in a position pointing down away from strip 12 for direct engagement by the hook-receiving surfaces 26 of strips 24 to form therewith a tunnel, tube or passageway 28 within which brassiere strap 30 is slidingly received.

In practice, three strips 24 on one side are first joined to tabs 20, after which all tabs 20 are curved down and around brassiere strap 30 and connected together. Surfaces 26 of strips 24 bridge the two tabs 20 forming each pair on opposite sides of strip 12 to form the desired cradle for strap 30. Thus, strap 30 can slide longitudinally, but is prevented from sideward shifting while between strips 12 and 24, particularly when the hooks 14 of main body 18 of strip 12 are releasably connected to the underside of the brassiere wearer's slip, blouse, sweater or other garment 32 (FIG. 7) which lies directly over the brassiere bearing strap 30.

It will be understood that two retainers 10 will be used for each brassiere, one for each brassiere strap 30. Garments releasably held in this way cannot move to a position wherein they uncover a bra strap. It should be noted that by having the indented ends 11 on elongated strip 12, rather than straight ends, a smoother surface is presented. It has been noted that a straight end strip results in a tendency for the strip, when in place on a curved shoulder, to extend outwards away from the bra strap, thereby presenting an unsightly bulge. The indented ends overcome this problem. The result is a comfortable retainer, effective for its intended purposes and easy to fix in place and remove as needed.

FIGS. 3, 5, 6 and 8

A second preferred embodiment of the improved brassiere strap retainer of the present invention is schematically depicted in FIGS. 3, 5 and 6 of the drawings. Thus, retainer 10*a* is shown. Components thereof similar to those retainer 10 bear the same numerals but are succeeded by the letter "a".

Retainer 10*a* is substantially identical to retainer 10, except that instead of three or so small strips 24, there is a single second strip 24*a*, which is substantially co-extensive with main body 18*a* of strip 12*a*. The underside of strip 24*a* bears hook-receiving loops or is felted or otherwise designed to releasably hold hooks 14*a*. In FIGS. 5 and 6 the underside of strip 24*a* is shown releasably holding hooks 14*a* of tabs 20*a*, while hooks 14*a* of main body 18*a* of strip 12*a* releasably adhere to the underside of garment 32*a*. Brassiere strap 30*a* is cradled between strips 12*a* and 24*a* using tabs 20*a* as the connectors between those two strips. Retainer 10*a* has substantially the advantages of retainer 10 and is somewhat simpler to use, since there is only one strip 24*a*.

If desired, strips 24 can be permanently attached to three tabs 20, by sewing, glueing or other like means. This would prevent the strips 24 from getting misplaced. In like manner, one side of strip 24*a* could also be permanently attached to one row of tabs 20.

FIG. 8

Another preferred embodiment of the invention is shown in FIG. 8, with components similar to those of retainer 10*a* bearing the same numerals but succeeded by the letter "b".

The essential difference between the retainer shown in FIG. 8 and the retainer shown in FIGS. 3, 5 and 6 is in the placement of strip 24*b*. In FIG. 8, strip 24*b* partially overlies strip 12*b*, and is permanently attached to strip 12 by being glued to tab 20*b*. When in place on the bra strap, the over-lap arrangement prevents hooks 14*b* from contacting the skin of the wearer, resulting in an improved, more comfortable arrangement.

Various other modifications, changes, alterations and additions can be made in the improved brassiere strap retainer of the present invention and in the components and parameters thereof. All such modifications, changes, alterations and additions as are within the scope of the appended claims form part of the present invention.

What is claimed is:

1. An improved brassiere strap retainer for securing a brassiere strap to a garment, said retainer comprising, in combination:

a) a first generally flat strip having a top surface and a generally smooth bottom surface, said first strip having a plurality of hooks protruding upwardly from the top surface thereof, said first strip having a plurality of spaced tabs protruding laterally from the sides thereof and bearing certain of said hooks, said tabs being looped around and spaced below said bottom surface so that said hooks of said tabs project downwardly from said first strip; and, b) a second flat strip secured to at least one of said hook bearing spaced tabs and having a generally smooth top surface and a bottom surface bearing hook-receiving material to which the hooks of said tabs are releasably connected, said two strips forming an openable hollow tube to slidingly receive a brassiere strap for anchoring said retainer to a garment by those hooks on said first strip upper surface which are not on said tabs.

2. The improved brassiere strap retainer of claim 1 wherein said retainer consists only of said two strips.

3. The improved brassiere strap retainer of claim 2 wherein said second strip is substantially co-extensive with said first strip except for said tabs.

4. The improved retainer of claim 3 wherein said second strip overlaps and is fixedly secured to said first strip along one side thereof.

5. The improved brassiere strap retainer of claim 1 wherein said hook-receiving material comprises loops.

6. The improved brassiere strap retainer of claim 1 wherein said hook-receiving material comprises felted material.

7. The improved brassiere strap retainer of claim 1 wherein said hook-receiving material is on the top surface of said second strip.

8. The improved brassiere strap retainer of claim 1 wherein said hook-receiving material is on the bottom surface of said second strip.

9. The improved retainer of claim 1 wherein said first flat strip has indented end portions which extend inwardly from the ends thereof to the centerline of said strip.

10. The improved retainer of claim 1 wherein said second flat strip is fixedly secured to said tabs by one of glueing or sewing.

11. The improved retainer of claim 1 wherein said second flat strip is wider and longer than said first flat strip.

12. An improved brassiere strap retainer for securing a brassiere strap to a garment, said retainer comprising, in combination:

a) a first generally flat strip having a top surface and a generally smooth bottom surface, said first strip having a plurality of hooks protruding upwardly from the top surface thereof, said first strip having a plurality of spaced tabs protruding laterally from the sides thereof and bearing certain of said hooks, said tabs being looped around and spaced below said bottom surface so that said hooks of said tabs project downwardly from said first strip; and, b) a second flat strip having a generally smooth top surface and a bottom surface bearing hook-receiving material to which the hooks of said tabs are releasably connected, said two strips forming an openable hollow tube to slidingly receive a brassiere strap for anchoring said retainer to a garment by those hooks on said first strip upper surface which are not on said tabs, c) wherein said retainer includes a plurality of said second strips bridging said tabs of said first strip, each said second strips crossing from one side of said first strip to the opposite side of said first strip.

* * * * *